US006631851B1

(12) United States Patent
Adkins et al.

(10) Patent No.: US 6,631,851 B1
(45) Date of Patent: Oct. 14, 2003

(54) ATOMIZER WHEEL WITH IMPROVED NOZZLE FOR ROTARY ATOMIZERS AND METHOD OF OBTAINING MICROSPHERICAL SOLID PARTICLES

(75) Inventors: Bruce D. Adkins, League City, TX (US); Sean Vannoy Garner, LaPorte, TX (US)

(73) Assignee: Akzo Nobel N.V. (NL)

( * ) Notice: Subject to any disclaimer, the term of this patent is extended or adjusted under 35 U.S.C. 154(b) by 0 days.

(21) Appl. No.: 09/523,435

(22) Filed: Mar. 10, 2000

Related U.S. Application Data

(60) Provisional application No. 60/125,850, filed on Mar. 24, 1999.

(51) Int. Cl.[7] ..... B05B 17/04; B05B 3/10

(52) U.S. Cl. ..... 239/7; 239/223; 239/224; 239/601; 239/568; 239/591

(58) Field of Search ..... 239/274, 223, 239/224, 601, 568, 591

(56) References Cited

U.S. PATENT DOCUMENTS

| | | | | | |
|---|---|---|---|---|---|
| 2,700,577 | A | * | 1/1955 | Oace | 239/601 X |
| 2,902,223 | A | * | 9/1959 | Nyrop | 239/223 |
| 2,920,830 | A | * | 1/1960 | Nyrop et al. | 239/224 X |
| 3,101,906 | A | * | 8/1963 | Webber | 239/601 X |
| 3,273,805 | A | * | 9/1966 | Hall | 239/601 X |
| 3,447,756 | A | * | 6/1969 | Lawrence, Jr. | 239/601 X |
| 3,454,226 | A | | 7/1969 | Nielsen | 239/224 |
| 3,887,133 | A | * | 6/1975 | Staarup et al. | 239/224 |
| 4,121,770 | A | | 10/1978 | Straarup et al. | 239/224 |
| 4,684,065 | A | | 8/1987 | Svarrer | 239/224 |

FOREIGN PATENT DOCUMENTS

| | | | | |
|---|---|---|---|---|
| DE | 3339222 | * | 5/1985 | 239/601 |

* cited by examiner

*Primary Examiner*—Robin O. Evans
(74) *Attorney, Agent, or Firm*—Louis A. Morris

(57) ABSTRACT

The present invention pertains to an improved nozzle, particularly for use in wear-resistant rotary atomizers, to atomizer wheels containing such improved nozzles and to a method for obtaining microspherical particles with a narrower particle size distribution when using such nozzles. The atomizer wheels and nozzles have at least the same wear resistance as those described in the prior art, but have been improved to provide microspherical particles with a very narrow particle size distribution. The nozzle of the present invention comprises a flow channel in the shape of a vertical slot that may be lined with wear-resistant sintered material. The vertical slot may be uniformly rounded. It was found that when these improved nozzles are used for spray-drying suspensions, microspherical particles with a narrower particle size distribution are obtained than when using nozzles with cylindrical flow channels.

9 Claims, 4 Drawing Sheets

ATOMIZER WHEEL WITH IMPROVED NOZZLE FOR ROTARY ATOMIZERS AND METHOD OF OBTAINING MICROSPHERICAL SOLID PARTICLES

This application claims priority of U.S. Provisional Patent Application No. 60/125,850, filed on Mar. 24, 1999.

BACKGROUND OF THE INVENTION

1. Field of the Invention

The present invention pertains to an improved nozzle for use in wear-resistant rotary atomizers, to atomizer wheels containing said improved nozzles and to a method for employing said nozzles.

2. Discussion of the Prior Art

Wear-resistant rotary atomizers are described in Niro patents U.S. Pat. No. 3,454,226, U.S. Pat. No. 4,121,770 and U.S. Pat. No. 4,684,065. Those patents describe atomizer wheels for atomizing slurries of a highly abrasive material, comprising a wheel hub and a mainly cylindrical external wall defining an annular chamber of a substantially bowl-like cross-sectional shape coaxially surrounding said hub, a number of substantially horizontal and radial ejection apertures distributed over the circumference of said external wall. During operation the supplied slurry is ejected outwards through said ejection apertures in atomized form into a surrounding drying chamber in which the fine particles formed by the atomization are dried so that their content of solids drops down to the bottom of the drying chamber as a fine powder.

U.S. Pat. No. 3,454,226 describes nozzles of a wear-resistant sintered material arranged in each of said apertures fitting loosely with respect to said external wall, the nozzles projecting into said annular chamber. The use of wear-resistant sintered material for the nozzles was stated to be necessary because of the very hard wear which takes place on account of the very high velocities of discharge from the atomizer wheel caused by the centrifugal force when atomizing suspensions which contain solid particles of a hard material.

In U.S. Pat. No. 4,684,065 the nozzle of U.S. Pat. No. 3,454,226 is replaced by a nozzle assembly which comprises a lining of wear-resistant sintered material arranged in the apertures by means of replaceable steel bushings fitting loosely with respect to said external wall. The nozzle assembly is held in place by flexible sealing rings which also prevent liquid penetrating into the space between the aperture wall and the nozzle assembly. A flat recess is formed in the internal side of the bushing facing the lining arranged therein. Said flat recess extends in the axial direction of the bushing on either side. The claimed advantage of this design is that upon inevitable flexing of the atomizer wall under rotation, the bushing can deform without fracturing the brittle ceramic liner arranged therein.

The nozzles described in the above-mentioned patents and the commercially available nozzles have flow channels of essentially cylindrical shape, although in FIG. 4 of U.S. Pat. No. 3,454,226 also a nozzle having a square cross-section is depicted. The specific designs described in the prior art provide atomizer wheels and nozzles which are highly wear-resistant and have a long lifetime. The present invention provides atomizer wheels and nozzles having the same wear resistance as the ones described in the Niro patents or even better, but at the same time, the nozzles have been improved to provide microspherical particles with a more narrow particle size distribution.

SUMMARY OF THE INVENTION

In one embodiment, the present invention is a nozzle for a rotary atomizer comprising a flow channel in the form of a vertical slot.

In a second embodiment, the present invention is an atomizer wheel for atomizing slurries of a highly abrasive material, comprising a wheel hub and a mainly cylindrical external wall defining an annular chamber of a substantially bowl-like cross-sectional shape coaxially surrounding the hub. A number of substantially horizontal and radial ejection apertures are distributed over the circumference of the external wall. A nozzle comprised of a wear-resistant sintered material is arranged in each of said apertures and fitts loosely with respect to the external wall. The nozzle projects into the annular chamber and has a flow channel in the form of a vertical slot.

In a third embodiment, the present invention is a method of obtaining solid particles of relatively small particle size distribution. A slurry of solid material is atomized by ejecting the slurry through at least one ejection nozzle into a drying chamber in which particles of the solid material are formed by the atomization are dried and collected. The ejection nozzle comprises a flow channel in the form of a vertical slot.

Other embodiments of the invention lie in details concerning nozzle constriction, particularly with regard to the handling of abrasive solid material, and details concerning the method of obtaining the solid particles.

DETAILED DESCRIPTION OF THE INVENTION

Figure 1:
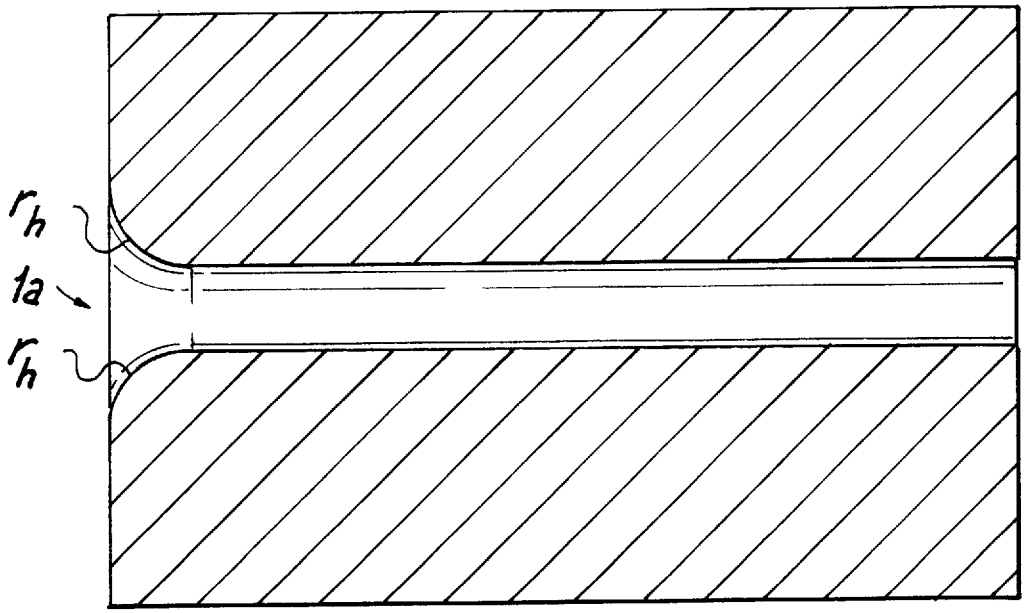
FIG. 1 is a partial horizontal sectional view of the nozzle according to the invention.

The nozzle of the present invention comprises a flow channel in the shape of a vertical slot. It was found that when these improved nozzles are used for spray-drying suspensions, microspherical particles with a narrower particle size distribution are obtained than when using nozzles with cylindrical flow channels. Since it is contemplated that the suspensions being spray dried may comprise abrasive particles, the flow channel within the nozzle may be lined with wearresistant sintered material.

Within the context of this specification, the term "wear-resistant sintered material" means a material where the hard grains are stably interconnected no matter whether such interconnection has been effected by fusing together the surfaces of the grains or by embedding the grains in some basic substance such as, by way of example, is being used in the manufacture of tungsten carbide bodies. The term "vertical slot" means a slot where the horizontal axis is shorter than the vertical axis.

To ensure flow stability, it is preferred that the flow channel of the nozzle has the form of a uniformly rounded slot. The term "uniformly rounded" means that the cross-section of the slot perpendicular to the flow direction has rounded corners. Large radii of curvature are preferred at the inlet of the flow channel to ensure flow stability. The flow channel may be tapered.

For the inlet radii of curvature it has been found that when the horizontal radius of curvature is larger than the vertical radius of curvature, the nozzle provides a combination of optimal liquid spreading along the wall of the flow channel, which results in homogeneous atomization, and optimal flow capacity, which results in low viscous drag and inlet turbulence. Herein the horizontal radius of curvature and the vertical radius of curvature are defined as follows. When using x to refer to the direction along the minor axis of the slot, y is down the flow channel and z is vertical, i.e. along the major axis of the slot. To generate the surface having the horizontal radius of curvature, a 90° arc must be taken in the xy (horizontal) plane with a radius rh, and it must be extruded in the z direction. To generate the surface of revolution with the vertical radius of curvature, the 90° arc is placed in the yz (vertical) plane with radius rv. However, because the ends of the slot are rounded, this arc is not extruded along x but rather, is rotated around the centerline of the rounded hemicircle at the ends of the slot.

The optimal dimensions for the slot height (the vertical axis) are determined by the desired particle size distribution improvement and the size limitations of the atomiser wheel. The optimal slot width (the horizontal axis) can be selected to give approximately the same cross-sectional area for the flow channel as typically found in the nozzles of the prior art as described in the Niro patents.

It was found that when the nozzle of the present invention is used, it is not necessary to employ a two-piece nozzle assembly with a metal bushing. A single-piece nozzle made entirely of wear-resistant sintered material can survive the rotational forces and wall flex, so long as flexible sealing rings are employed between the nozzle and the ejection aperture. Such sealing rings are described in U.S. Pat. No. 4,684,065. For further details reference is made to this patent.

Of course, the nozzle according to the invention may also be a two-piece nozzle assembly comprising a metal bushing lined with a lining of a wear-resistant sintered material having a flow channel in the form of a, preferably uniformly rounded, vertical slot. Suitable metals for the bushing include (stainless) steel, nickel alloys such as hastelloy, titanium, tantalum, zirconium etc. Said steel bushing may further be provided with a flat recess so as to avoid fracture of the wear-resistant sintered lining material upon deformation of the steel bushing due to the high rotational forces. In this embodiment flexible sealing rings can also be employed.

In a further embodiment of the invention, the nozzle is provided with an outwardly directed shoulder abutting against a correspondingly shaped, oppositely directed shoulder in the ejection aperture of the atomizer wheel. During atomization of the slurry, the nozzles may be exposed to wear which from time to time may even be very heavy. This wear, however, is restricted to certain well-defined areas. In the present embodiment, the nozzle can be rotated around the axis of the flow channel as it gradually becomes worn, in order to increase its lifetime.

The present invention is further directed to an atomizer wheel for atomizing slurries of a highly abrasive material, comprising a wheel hub and a mainly cylindrical external wall defining an annular chamber of a substantially bowl-like cross-sectional shape coaxially surrounding said hub, a number of substantially horizontal and radial ejection apertures distributed over the circumference of said external wall, with a nozzle comprised of a wear-resistant sintered material arranged in each of said apertures fitting loosely with respect to said external wall, said nozzle projecting into said annular chamber and having a flow channel in the form of a vertical slot. To ensure flow stability, it is preferred that the flow channel of the nozzle has the form of a uniformly rounded vertical slot.

The atomizer wheel may be provided with one-piece nozzles made entirely of wear-resistant sintered material or with two-piece nozzles comprising a metal bushing lined with a wear-resistant sintered lining. Further, the nozzles may be provided with an outwardly directed shoulder abutting against a correspondingly shaped, oppositely directed shoulder in the ejection aperture of the atomizer wheel.

Figure 3:
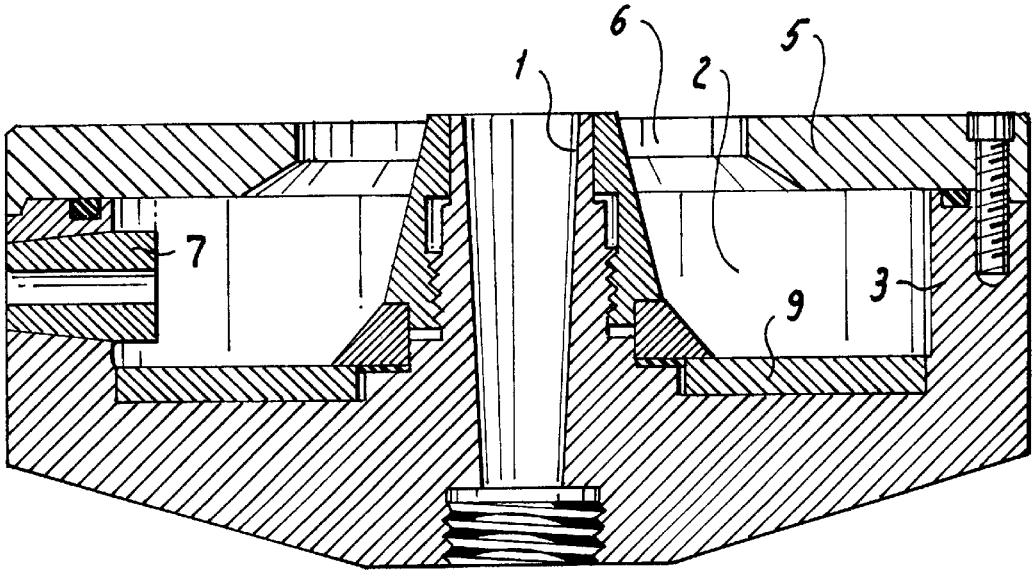
FIG. 3 is a partial sectional view of an atomizer wheel with a nozzle according to an embodiment of the invention.

The atomizer wheel illustrated in FIG. 3 comprises an annular chamber 2 having a substantially bowl-like cross-sectional shape provided with a central hub 1, a substantially cylindrical external wall 3, a surrounding drying chamber 3*a*, and a cover 5. In the cover 5 an aperture 6 is provided concentrically around the hub 1 through which the slurry to be atomized is supplied to the atomizer wheel.

Along the circumference of the external wall 3 of the atomizer wheel a number of ejection apertures are provided, through which during operation a supplied slurry is ejected outwards in atomized form into a surrounding drying chamber in which the fine particles formed by the atomization are dried so that their content of solids drops down to the bottom of the drying chamber as a fine powder. In order to prevent wear on the atomizer wheel itself nozzles 7 of a wear-resistant sintered material are inserted in the individual ejection apertures.

The slurry entering the nozzle of the invention will contain particles of various composition and size. The minute droplets comprising the spray from the nozzle (liquid and solids in a gas dispersion) include the liquid of the suspension and solids comprising mixtures of the various component particles. When the droplets dry, olid particles comprising such mixtures may be recovered.

Figure 2:
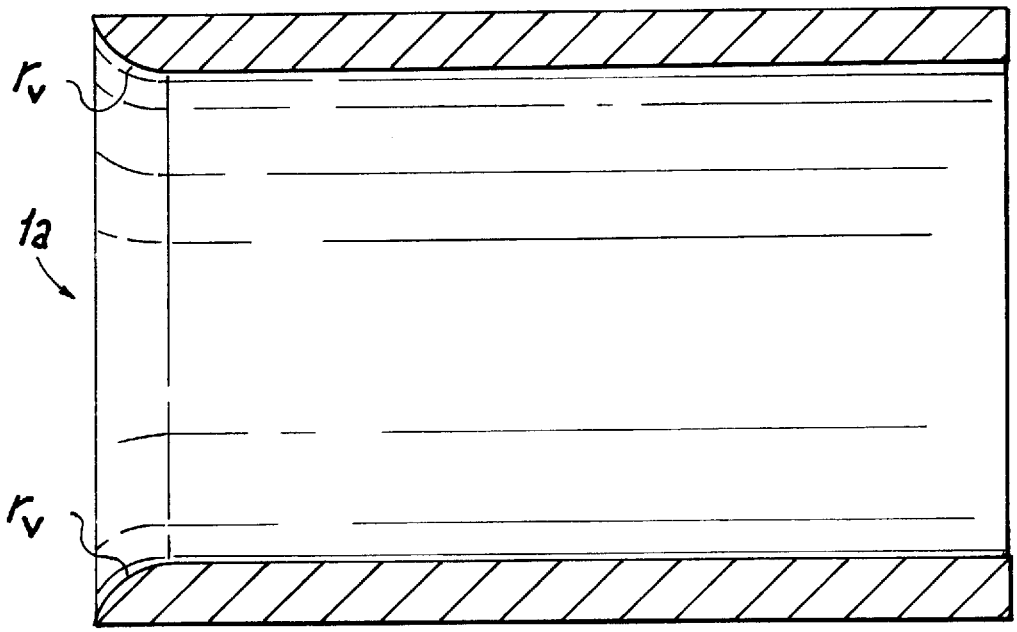
FIG. 2 is a partial vertical sectional view of the nozzle according to the invention.

The nozzle of the invention as previously described is shown in FIG. 1 and FIG. 2 which are horizontal and vertical sectional views, respectively. These views of the nozzle illustrate the nozzle inlet 1*a* comprising a uniformly rounded slot where the horizontal radius of curvature of the slot is larger than the vertical radius of curvature, as those terms have been previously defined. Also shown are outwardly directed shoulder 1*b* and a groove 1*c* around the outside of the nozzle for placement of the sealing ring.

FIG. 1 and FIG. 2 serve to graphically illustrate the definitions of "horizontal radius of curvature" and "vertical radius of curvature", respectively, as given above.

Figure 4:
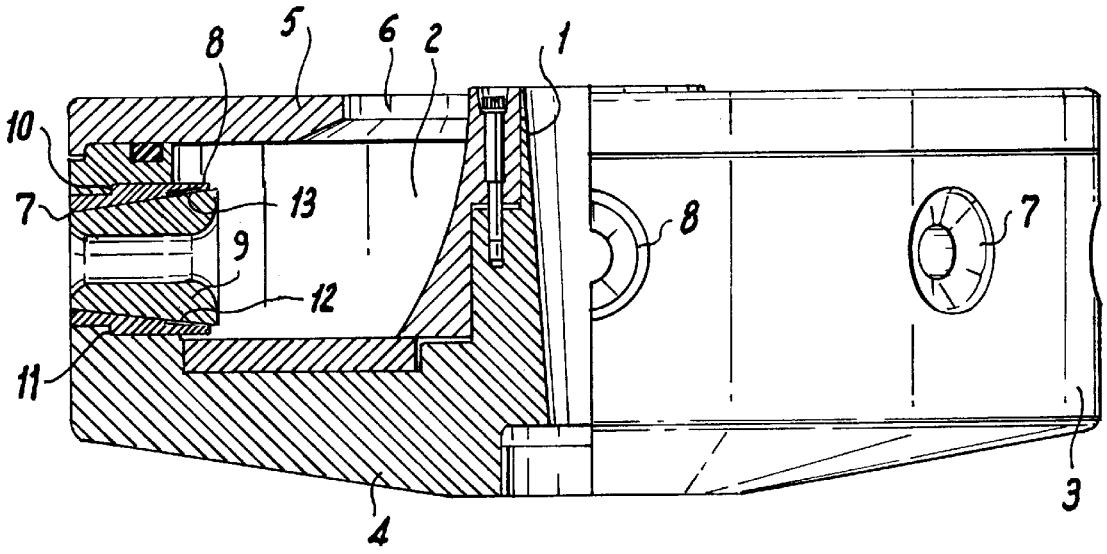
FIG. 4 is a partial sectional view of an atomizer wheel with a nozzle according to another embodiment of the invention.

The atomizer wheel illustrated in FIG. 4 comprises an annular chamber 2 having a substantially bowl-like cross-sectional shape provided with a central hub 1, a substantially cylindrical external wall 3, a surrounding drying chamber 3*a*, a bottom portion 4, and a cover 5. In the cover 5 an aperture 6 is provided concentrically around the hub 1 through which the slurry to be atomized is supplied to the atomizer wheel.

Along the circumference of the external wall 3 of the atomizer wheel a number of ejection apertures are provided, through which during operation a supplied slurry is ejected outwards in atomized form into a surrounding drying chamber in which the fine particles formed by the atomization are dried so that their content of solids drops down to the bottom of the drying chamber as a fine powder. In order to prevent wear on the atomizer wheel itself, nozzles 7 comprising a bushing 8 with wear-resistant linings 9 are inserted in the individual ejection apertures. The bushing 8 is made from steel and provided with an outwardly directed shoulder 10 abutting against a correspondingly shaped, oppositely directed shoulder 11 in the ejection aperture. As mentioned before, the bushing 8 is fitting loosely in the aperture and, in order to prevent particles from penetrating into the clearance thus provided, it is sealed against the external wall 3 by means of a sealing ring 12 arranged near the inner surface of the wall 3.

To allow elastic deformation of the bushing without transferring excessive stresses to the ceramic lining 9, the bushing 8 is provided with a flat recess 13 in its inner surface facing the lining. In the embodiment shown, the recess 13 extends from below the recess of the sealing ring 12 and close to the internal end of the bushing 8, i.e. substantially throughout that portion of the bushing which in the worst case is exposed to stresses which if transferred directly to the ceramic lining could damage it.

Figure 5:
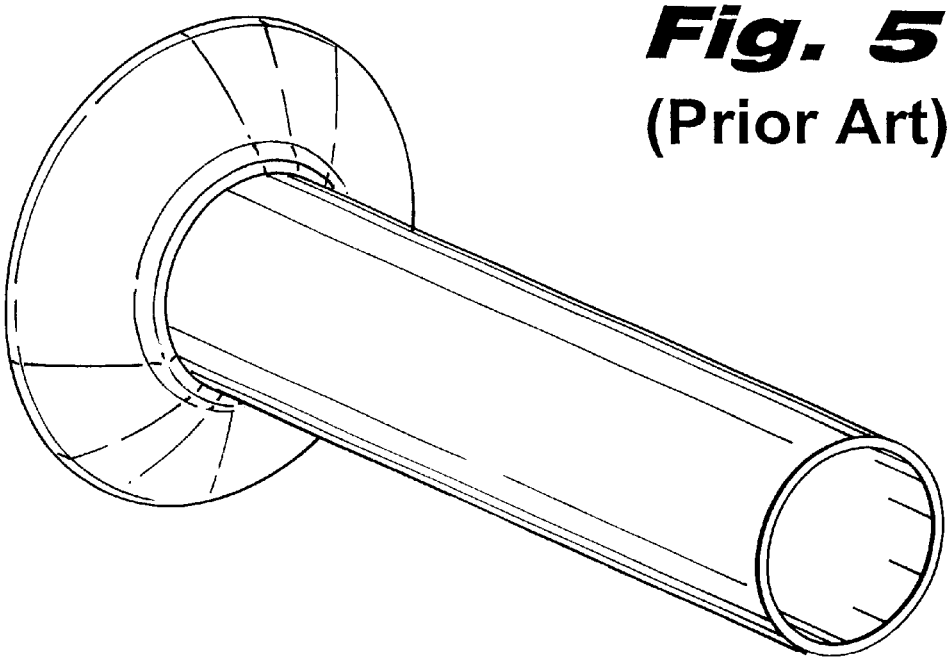
Fig. 5 (Prior Art)
FIG. 5 is a three-dimensional illustration of the flow channel present in the nozzles according to the prior art.

In FIG. 5 a three-dimensional illustration of the flow channel present in the nozzles according to the prior art is given. Such conventional nozzles have an essentially cylindrical shape.

Figure 6:
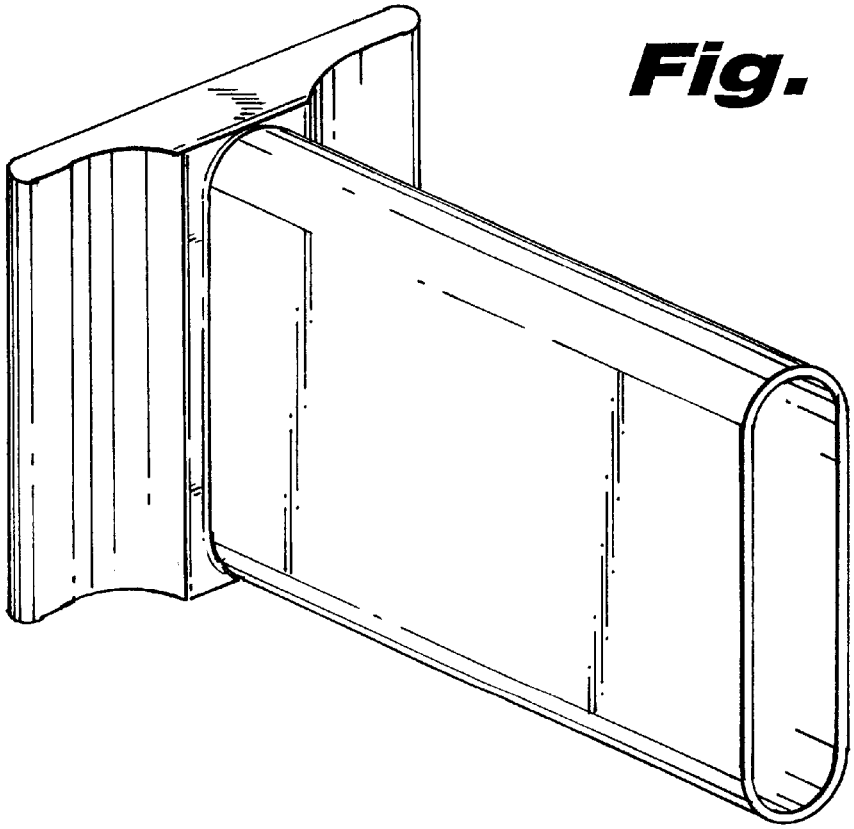
FIG. 6 is a three-dimensional illustration of the flow channel present in the nozzles according to the invention, FIG. 7 gives a graph of the percentage of product obtained having a diameter of less than 38 microns plotted against the percentage of product having a percentage larger than 150 microns.

In FIG. 6 a three-dimensional illustration of the flow channel present in the nozzles according to the invention is given. The nozzles according to the invention have flow channels in the form of a uniformly rounded vertical slot. In FIG. 5 a graph is provided which shows that a smaller particle size distribution is obtained when spray-drying a slurry using the atomizer wheel and nozzle according to the invention. The graph shows that an about 2% reduction in absolute amount of product having a particle size of less than 38 microns is obtained at a constant percentage of product greater than 150 microns. This amounts to a 10 to 20% narrowing of the particle size distribution.

Figure 7:
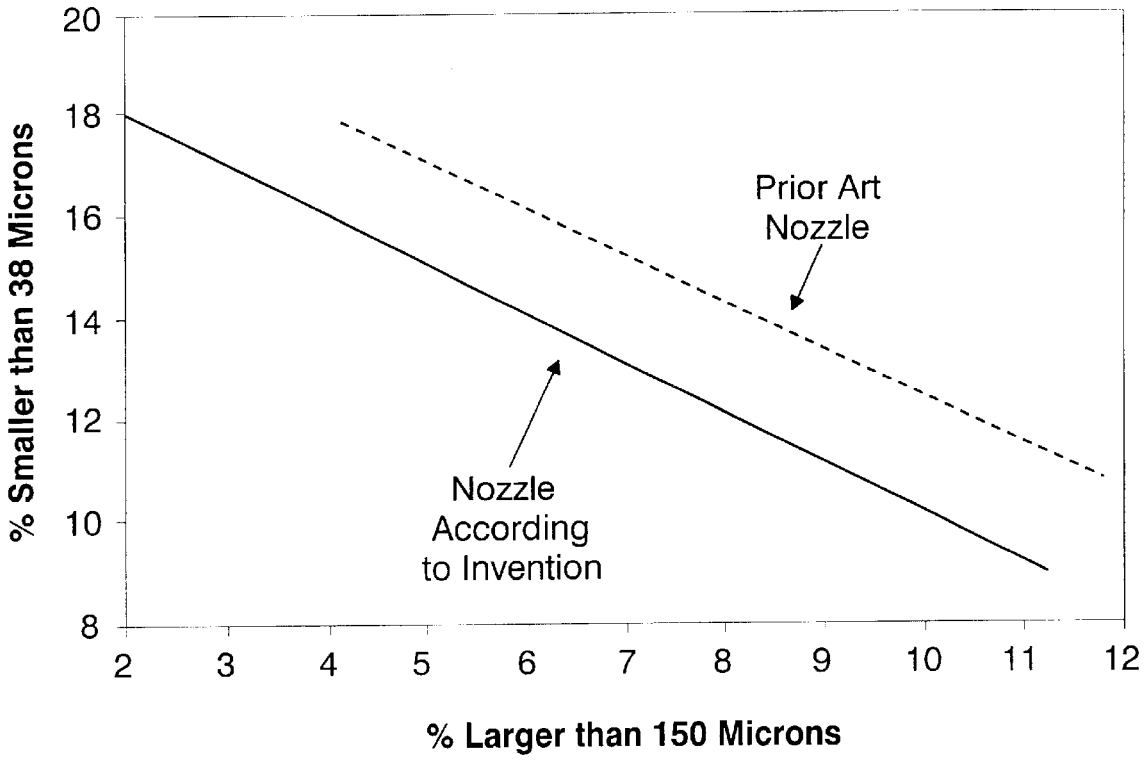

In FIG. 7 a graph is provided which shows that a smaller particle size distribution is obtained when spray-drying a slurry using the atomizer wheel and nozzle according to the invention. The graph shows that an about 2% reduction in absolute amount of product having a particle size of less than 38 microns is obtained at a constant percentage of product greater than 150 microns. This amounts to a 10 to 20% narrowing of the particle size distribution.

What is claimed is:

1. A nozzle for a rotary atomizer comprising a flow channel in the form of a uniformly rounded vertical slot having an inlet to which large radii of curvature are applied wherein the horizontal radius of curvature is larger than the vertical radius of curvature.

2. The nozzle of claim 1 provided with an outwardly directed shoulder.

3. The nozzle of claim 1 wherein said flow channel is lined with a wear-resistant sintered material.

4. The nozzle of claim 1 comprising a single-piece assembly made of wear-resistant sintered material.

5. The nozzle of claim 1 comprising a steel bushing lined with a lining of a wear-resistant sintered material having a flow channel in the form of a uniformly rounded vertical slot.

6. An atomizer wheel for atomizing slurries of a highly abrasive material comprising a wheel hub and a mainly cylindrical external wall defining an annular chamber of a substantially bowl-like cross-sectional shape coaxially surrounding said hub, a number of substantially horizontal and radial ejection apertures distributed over the circumference of said external wall, a nozzle comprised of a wear-resistant sintered material arranged in each of said apertures fitting loosely with respect to said external wall, said nozzle projecting into said annular chamber and having a flow channel in the form of a uniformly rounded vertical slot. having an inlet to which large radii of curvature are applied wherein the horizontal radius of curvature is larger than the vertical radius of curvature.

7. The atomizer wheel of claim 6 wherein the nozzle is provided with an outwardly directed shoulder abutting against a correspondingly shaped, oppositely directed shoulder in the ejection aperture.

8. The atomizer wheel of claim 6 wherein the nozzle comprises a metal bushing lined with a lining of a wear-resistant sintered material.

9. A method of obtaining microspherical solid particles of relatively small particle size distribution comprising atomizing a slurry of solid material in a rotary atomizer by ejecting said slurry through at least one ejection nozzle of the rotary atomizer into a drying chamber in which particles of solid material formed by the atomization are dried and collected, said ejection nozzle comprising a flow channel in the form of a uniformly rounded vertical slot having an inlet to which large radii of curvature are applied wherein the horizontal radius of curvature is larger than the vertical radius of curvature.

* * * * *